US012808164B2

(12) United States Patent
Villarreal et al.

(10) Patent No.: US 12,808,164 B2
(45) Date of Patent: Nov. 24, 2026

(54) WORK TOOL ASSEMBLY HAVING TIP ADAPTER AND ANTI-BENDING STABILIZER FOR SAME

(71) Applicant: Caterpillar Inc., Peoria, IL (US)

(72) Inventors: Josiah I. Villarreal, Peoria, IL (US); Eric T. Sinn, Tremont, IL (US); Caroline M. Brewer, Peoria, IL (US); Jonathan S. Borden, Peoria, IL (US); Dominyk L. Grudzinski, Miami, FL (US); Christy L. Lee, Eureka, IL (US); Daniel T. Unger, Yorkville, IL (US)

(73) Assignee: Caterpillar Inc., Peoria, IL (US)

( * ) Notice: Subject to any disclaimer, the term of this patent is extended or adjusted under 35 U.S.C. 154(b) by 405 days.

(21) Appl. No.: 18/483,728

(22) Filed: Oct. 10, 2023

(65) Prior Publication Data

US 2025/0116095 A1 Apr. 10, 2025

(51) Int. Cl.
*E02F 9/28* (2006.01)
*E02F 3/60* (2006.01)

(52) U.S. Cl.
CPC ..... *E02F 9/2825* (2013.01); *E02F 3/60* (2013.01); *E02F 9/2833* (2013.01)

(58) Field of Classification Search
CPC ..... E02F 9/2825; E02F 3/60; E02F 9/2833
See application file for complete search history.

(56) References Cited

U.S. PATENT DOCUMENTS

| | | | | |
|---|---|---|---|---|
| 7,299,570 | B2 * | 11/2007 | Emrich | H03K 19/0019 37/456 |
| 9,127,435 | B2 | 9/2015 | Bienfang et al. | |
| 9,200,433 | B2 | 12/2015 | Tasovski | |
| 9,605,416 | B2 | 3/2017 | Campomanes | |
| 9,632,200 | B2 | 4/2017 | Tasovski | |
| 9,951,500 | B2 | 4/2018 | Kunz | |
| 10,119,252 | B2 | 11/2018 | Campomanes | |
| 11,686,072 | B2 | 6/2023 | Sinn et al. | |
| 2012/0304508 | A1 * | 12/2012 | Guimaraes | E02F 9/2833 37/456 |
| 2017/0145664 | A1 * | 5/2017 | Campomanes | E02F 9/2858 |
| 2020/0095752 | A1 * | 3/2020 | Campomanes | E02F 9/2883 |
| 2022/0154433 | A1 * | 5/2022 | Sinn | E02F 9/2833 |

* cited by examiner

*Primary Examiner* — Theodore N Yao

(57) ABSTRACT

A work tool assembly includes a work tool lip and a plurality of tip adapters coupled to the work tool lip and each including an upper adapter leg, a lower adapter leg, and a mounting slot receiving a forward lip edge. Each of the upper adapter leg and the lower adapter leg includes a first restraint ledge and a second restraint ledge. The work tool assembly also includes anti-bending stabilizers welded to the work tool lip and each including a hold-down head in contact with one of the first restraint ledge or the second restraint ledge. The anti-bending stabilizers limit bending of the tip adapters by way of reacting bending loads on tooth tips of the work tool lip.

9 Claims, 5 Drawing Sheets

WORK TOOL ASSEMBLY HAVING TIP ADAPTER AND ANTI-BENDING STABILIZER FOR SAME

TECHNICAL FIELD

The present disclosure relates generally to a work tool assembly, and more particularly to limiting bending of a work tool tip adapter by way of anti-bending stabilizers.

BACKGROUND

Many different types of work tools are used with machinery in a range of operating environments from construction, forestry, and landfills, to material handling, mining, and still others. In many applications, work tools and related components can be subjected to extremely harsh conditions resulting in impacts, abrasion, and various types of loading. For certain operating environments engineers have developed a variety of replaceable elements for work tools such as guards, edges, and teeth or tooth tips. Such replaceable components can be swapped out for new components periodically rather than requiring replacement or servicing of larger or difficult to access parts of the machinery. It can also be desirable for parts of the work tool assembly to be temporarily removable to service the assembly such as by removing packed material. A great deal of research and development resources have therefore been directed at extending the service life of work tools, optimizing performance, and easing the labor of replacement or servicing of work tool parts where necessary. One example of a work tool used in a mining machinery application is set forth in U.S. Pat. No. 9,127,435 B2 to Bienfang et al.

SUMMARY

In one aspect, a work tool assembly includes a work tool lip having an upper lip surface and a lower lip surface each extending rearwardly from a forward lip edge, and a plurality of tip adapters. The plurality of tip adapters are arranged laterally along the forward lip edge, and each includes a front adapter end, a back adapter end, and a mounting slot receiving the forward lip edge and extending forwardly from the back adapter end. Each mounting slot is defined between an upper adapter leg in contact with the upper lip surface and a lower adapter leg in contact with the lower lip surface. At least one of the upper adapter leg and the lower adapter leg in each tip adapter includes, upon opposite lateral sides thereof, a first restraint ledge and a second restraint ledge, respectively. The work tool assembly also includes a plurality of anti-bending stabilizers each having a base attached to the work tool lip at a location laterally of one of the plurality of tip adapters, and a hold-down head extending outwardly of the base and in contact with one of the first restraint ledge or the second restraint ledge of the respective one of the plurality of tip adapters.

In another aspect, a tip adapter for a work tool includes an adapter body having a front adapter end with a tip mount, a back adapter end, and a mounting slot defined between an upper adapter leg and a lower adapter leg, for receiving a forward lip edge of a work tool lip, and extending forwardly from the back adapter end. At least one of the upper adapter leg and the lower adapter leg includes, upon opposite lateral sides thereof, a first restraint ledge and a second restraint ledge, respectively. The first restraint ledge and the second restraint ledge each include a laterally-facing contact surface, a base contact surface and a rearward-facing contact surface together forming a cutout in a respective one of the upper adapter leg or the lower adapter leg.

In still another aspect, an anti-bending stabilizer for a work tool includes a stabilizer body including a base with a downward-facing weld surface defining an at least partially curved footprint and a peripheral weld surface adjoining the downward-facing weld surface and extending upwardly and outwardly from the downward-facing weld surface. The stabilizer body further includes a neck, and a hold-down head extending outwardly from the neck and having a plurality of contact surfaces thereon. The plurality of contact surfaces includes a terminal end surface facing outward from the base, a first subterminal side surface, a second subterminal side surface, and a subterminal undersurface.

DETAILED DESCRIPTION

Figure 1:
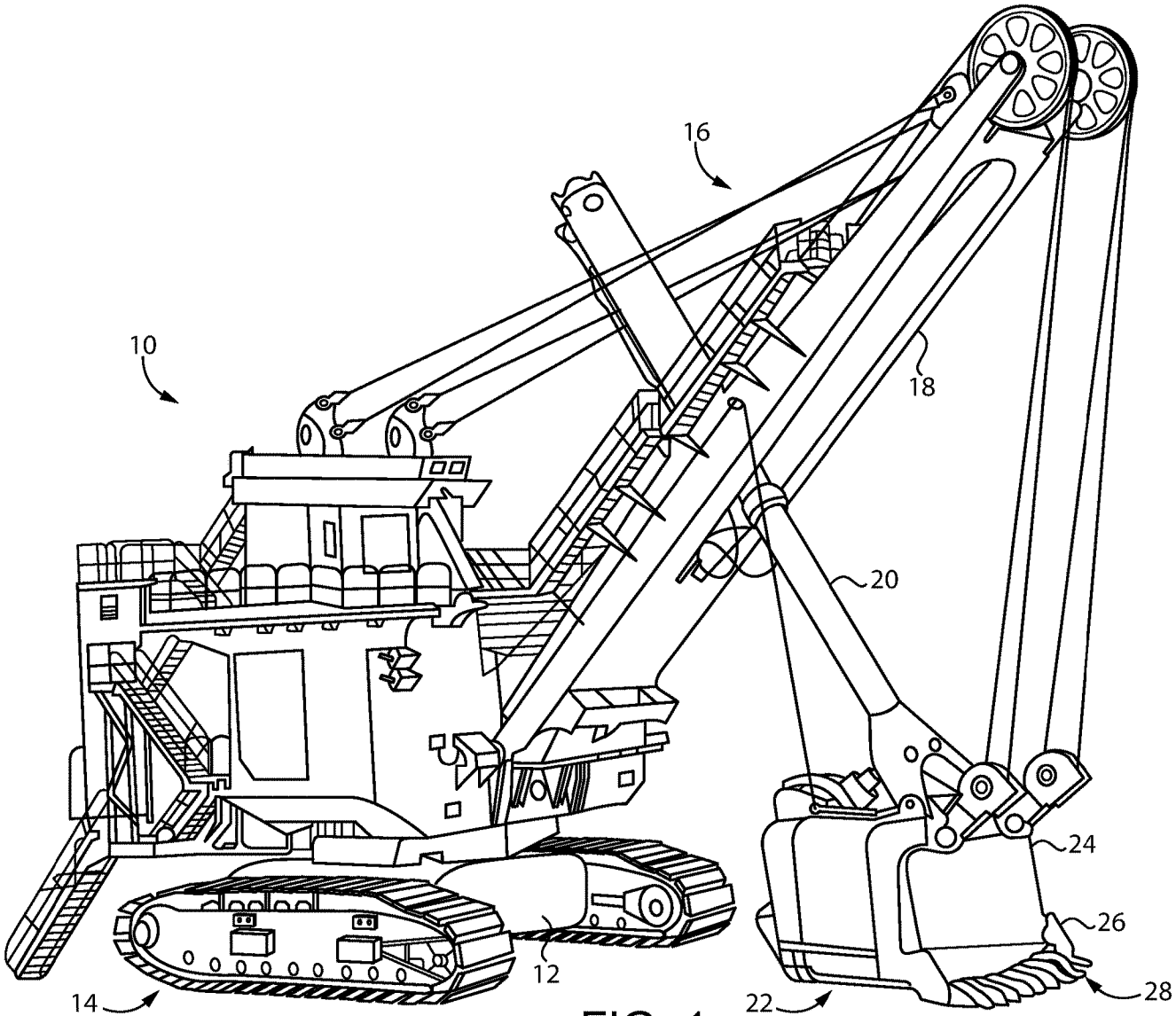
FIG. 1 is a diagrammatic view of a machine, according to one embodiment.
Figure 2:
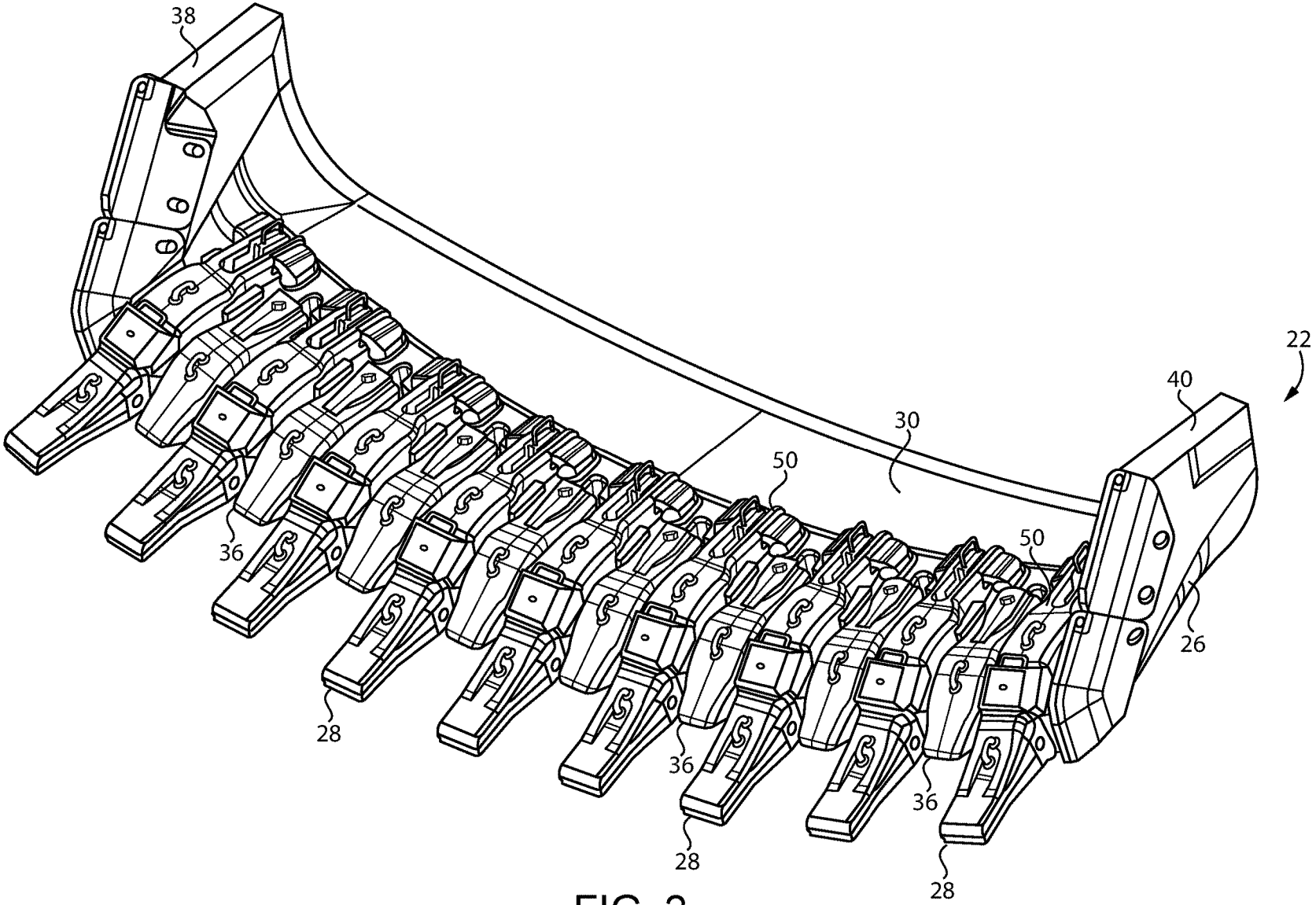
FIG. 2 is a diagrammatic view of a work tool assembly, according to one embodiment.

Referring to FIG. 1, there is shown a machine 10 according to one embodiment. Machine 10 is shown in the context of a mining machine having a frame 12 supported upon a ground-engaging track system 14. Machine 10 also includes an implement system 16 having a boom 18, a stick or handle 20 pivotably supported by boom 18, and a bucket or dipper 24 coupled to stick 20. The mining machine illustrated in FIG. 1 will be recognized by those familiar with the art as a rope shovel. A variety of other mining machines such as front shovels, as well as other types of off-highway machines entirely such as a tractor or loader, are within the scope of the present disclosure. Implement system 16 can be operated to capture, lift, and dump material at a working face of a mine, for instance.

Figure 3:
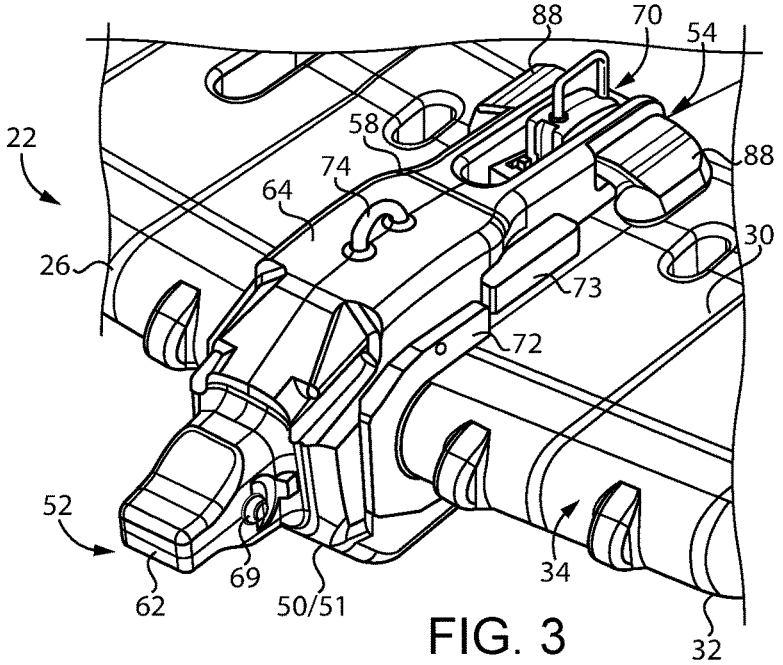
FIG. 3 is a diagrammatic view of a portion of a work tool assembly, according to one embodiment.
Figure 4:
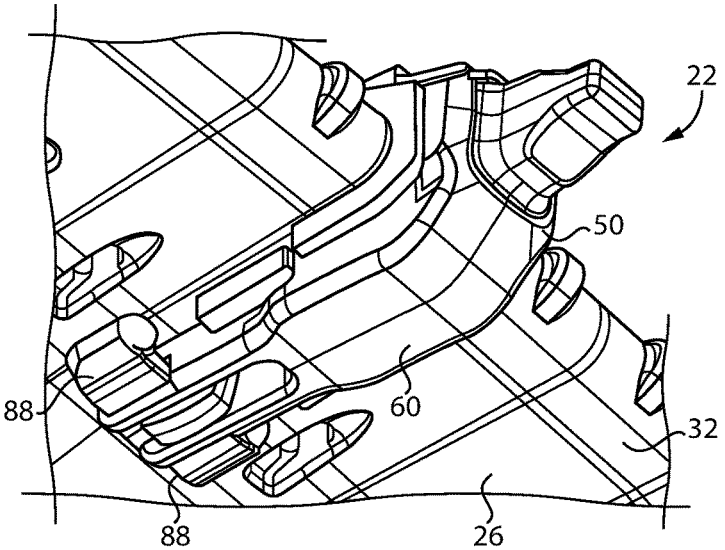
FIG. 4 is another diagrammatic view of a portion of a work tool assembly, according to one embodiment.

Bucket 24 is part of a work tool assembly 22 and may include a work tool lip 26 that is a separate part or assembly that can be attached to a main bucket body. Also visible in FIG. 3 are a plurality of tooth tips 28 supported on work tool lip 26. Over the course of service, tooth tips 28 may be replaced as wear, damage, etc. occurs. Associated supporting structures for tooth tips 28 may also be periodically replaced or serviced. It has been observed that certain types of bending loads upon supporting structures for tooth tips 28, for example, can lead to premature performance degradation or failure in work tool assembly 22. As will be further apparent from the following description, the present disclosure contemplates solutions and improvements relative to these and other objectives.

Referring also now to FIGS. 2-5 work tool lip 26 includes an upper lip surface 30 and a lower lip surface 32 each extending rearwardly from a forward lip edge 34. A plurality of forward tooth tips 28 are each mounted to a respective one of a plurality of tip adapters 50 arranged laterally along forward lip edge 34 of work tool lip 26. A plurality of set-back tooth tips 36 are arranged laterally along forward lip edge 34 and in an alternating arrangement with the plurality of tip adapters 50. Set back tooth tips 36 may be set back relative to forward tooth tips 28. Set-back tooth tips 36 could be positioned upon tip adapters or instead could be attached directly to work tool lip 26, or omitted from the design in some embodiments. As suggested above, work tool assembly 22 may include bucket 24. Other embodiments could include a blade or still another work tool type. Work tool lip 26 may thus include a bucket lip, and including a first upturned outboard lip edge 38, and a second upturned outboard lip edge 40. Each of upper lip surface 30 and lower lip surface 32 may extend laterally between first upturned outboard lip edge 38 and second upturned outboard lip edge 40.

In the present description, a "lateral" direction or "laterally" means in a direction toward one of outboard lip edge 38 and outboard lip edge 40. A forward direction means generally toward forward lip edge 34, or a continuation of that direction away from forward lip edge 34. A rearward or back direction has an opposite meaning. Fore-aft means forward-rearward conventionally. Tip adapters 50 are arranged laterally along forward lip edge 34 and each includes an adapter body 51. Adapter body 51, referred to at times interchangeably with tip adapter 50, may be a one-piece metallic casting in some embodiments. Each of the plurality of tip adapters 50, referred to hereinafter at times in the singular, may be identical to one another and each includes a front adapter end 52, a back adapter end 54, and a mounting slot 56 receiving forward lip edge 34 and extending forwardly from back adapter end 54.

Each mounting slot 56 is defined between an upper adapter leg 58 in contact with upper lip surface 30 and a lower adapter leg 60 in contact with lower lip surface 32. Tip adapter 50 may include upon front adapter end 52 a tooth tip mount 62 shaped for coupling within a void or recess to one of tooth tips 28. Attachment and locking structures including, for example, a tooth tip engagement boss 69 may be located upon front adapter end 62 and projects generally forward therefrom. As can also be noted from the drawings, front adapter end 62 may have a narrowed taper in a generally forward direction, although the present disclosure is not thereby limited.

Work tool assembly 22 may also include a plurality of wedge assemblies 70 that releasably fasten tip adapters 50 to work tool lip 26. In an embodiment, wedge assemblies 70 can be passed through tip adapters 50 to attach to work tool lip 26. Wedge assemblies 70 may be of known design. Work tool assembly 22 may also include a plurality of shims 72 and a plurality of static beams 73 coupled between adapter 50 and work tool lip 26 also according to known designs. Tip adapter 50 may also include a lifting eye 74.

Tip adapter 50 also includes a top surface 64 formed in part upon upper adapter leg 58, and an upper inside surface 66 formed on upper adapter leg 58. Tip adapter 50 also includes a bottom surface 68 and a lower inside surface 67 formed upon lower adapter leg 60. Mounting slot 56 is defined between upper inside surface 66 and lower inside surface 67.

Figure 6:
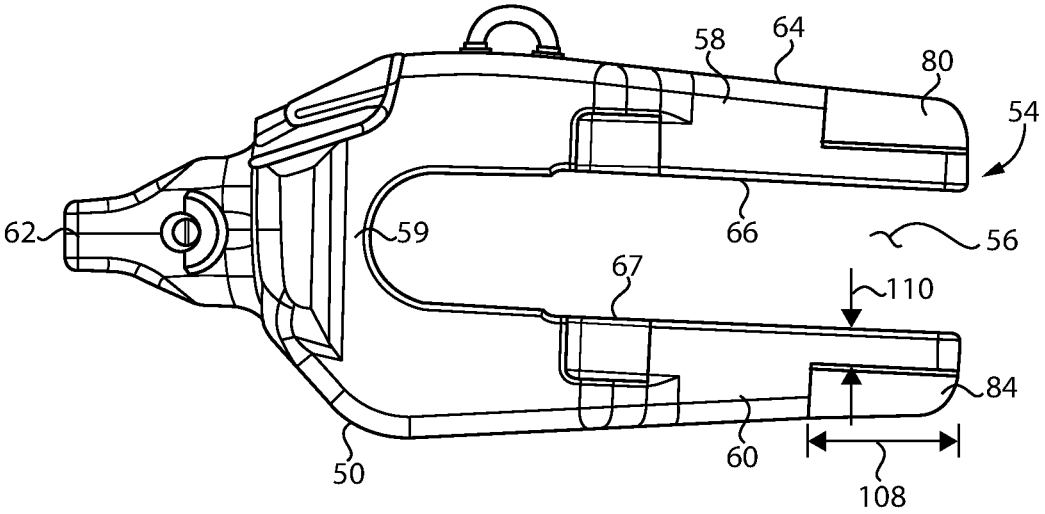
FIG. 6 is a side diagrammatic view of a tip adapter, according to one embodiment.
Figure 7:
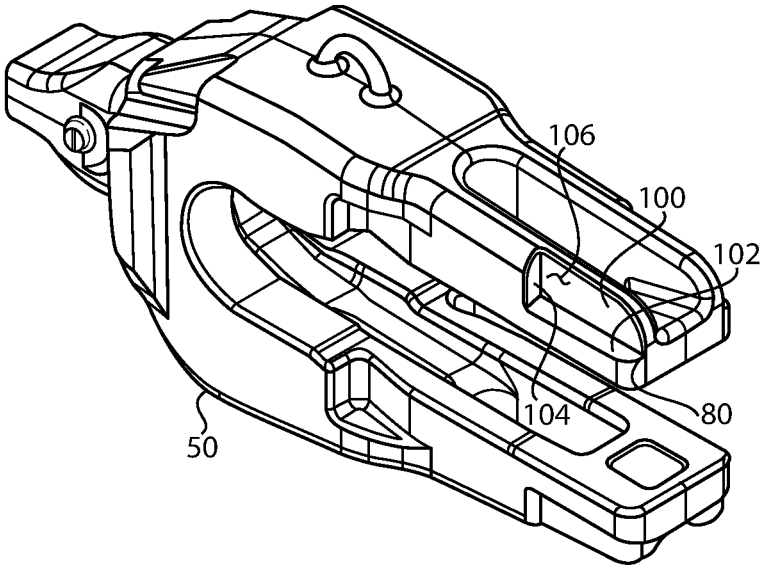
FIG. 7 is a perspective view of a tip adapter, according to one embodiment.
Figure 10:
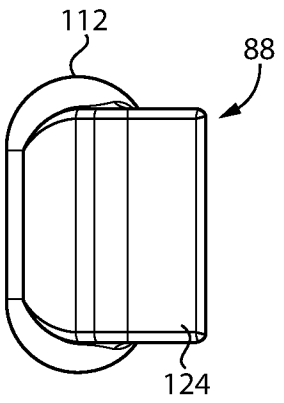
FIG. 10 is a top view of an anti-bending stabilizer, according to one embodiment.

Referring also now to FIGS. 6 and 7, at least one of upper adapter leg 58 and lower adapter leg 60 in each tip adapter 50 includes, upon opposite lateral sides 76 and 78 thereof, a first restraint ledge 80 and a second restraint ledge 82. In an embodiment, upper adapter leg 58 includes first and second restraint ledges 80 and 82, and lower adapter leg 60 includes third and fourth restraint ledges 84 and 86. Thus, embodiments are contemplated where only one of upper adapter leg 58 and lower adapter leg 60 includes restraint ledges. Description and discussion herein of any one restraint ledge can be understood by way of analogy to refer to any other restraint ledge. In a practical implementation, both upper adapter leg 58 and lower adapter leg 60 are equipped with restraint ledges, structured to receive anti-bending hardware to limit bending of tip adapter 50 relative to work tool lip 26 as further discussed herein.

To this end, work tool assembly 22 also includes a plurality of anti-bending stabilizers 88 each having a base 96 attached to work tool lip 26, such as by welding, at a location laterally of one of the plurality of tip adapters 50. Each of the plurality of anti-bending stabilizers 88, also referred to hereinafter at times in the singular, includes a hold-down head 98 extending outwardly of base 96 and in contact with one of first restraint ledge 80 or second restraint edge 82 of the respective one of the plurality of tip adapters 50. It is to be emphasized that "first" and "second" are used here for descriptive convenience, and thus not implying any ordering or particular structural arrangement. At least one adapter leg, and commonly both, in a tip adapter will be associated with two anti-bending stabilizers each in contact with a different restraint ledge. In a practical implementation strategy, anti-bending stabilizers 88 are arranged in a plurality of upper pairs each coupled to upper adapter leg 58 and a plurality of lower pairs each coupled to lower adapter leg 60, as clearly visible in the view of FIG. 5. First restraint ledge 80 and second restraint ledge 82, and by way of analogy third restraint ledge 84 and fourth restraint ledge 86, each include a laterally facing contact surface 100, a base contact surface 102, and a rearward-facing contact surface 104, together forming a cutout 106 in the respective one of upper adapter leg 58 and lower adapter leg 60. Each respective cutout 106 may include a three-sided cutout as illustrated.

Figure 5:
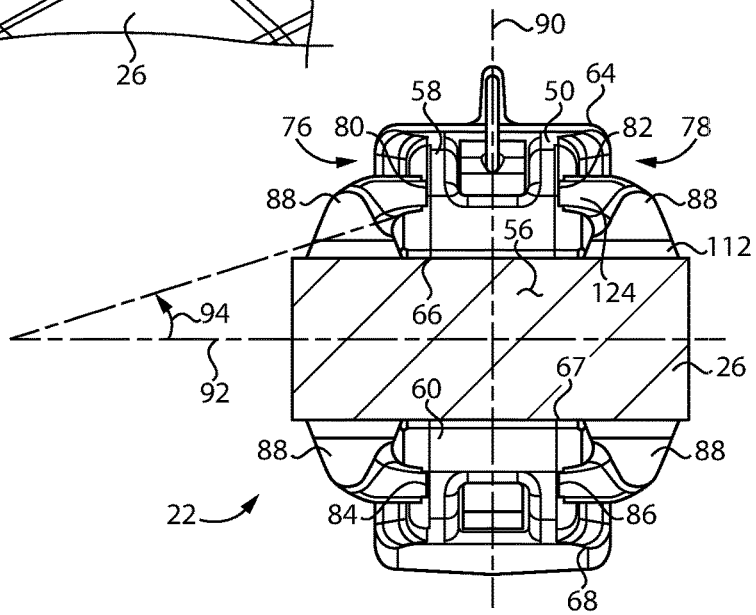
FIG. 5 is a sectioned view of a portion of a work tool assembly, according to one embodiment.

Tip adapter 50 may also include a curved connector portion 59 forming, together with upper adapter leg 58 and lower adapter leg 60, a C-shape, and tip mount 62 extends forwardly from curved connector portion 59. As depicted in FIG. 5, tip adapter 50 defines a vertical plane 90 extending vertically through tip adapter 50 and adapter body 51 and located equidistant between opposite lateral sides 76 and 78. As can also be noted from the drawings, each of first restraint ledge 80 and second restraint ledge 82 originates at back adapter end 54 and extends forwardly from back adapter end 54. Each base contact surface 102 may slope laterally outward and in a direction of work tool lip 22 from the respective laterally facing contact surface 100.

A horizonal plane 92 is defined between upper inside surface 66 and lower inside surface 67. Each base contact surface 102 may define a slope angle 94 to horizontal plane 92 opening in a laterally inward direction and ranging from 5° degrees to 60° in some embodiments. A ledge length 108 in a fore-aft direction is defined by base contact surface 102. A ledge elevation 110 normal to ledge length 108 and is defined between base contact surface 106 and mounting slot 56/upper inside surface 67. Ledge length 108 is greater than ledge elevation 110.

In one practical implementation ledge length 108 ranges from 100 millimeters to 300 millimeters, and ledge elevation 110 ranges from 5 millimeters to 100 millimeters. A ledge depth dimension, approximately into and out of the page in FIG. 6, may range from 5 millimeters to 30 millimeters. Among other things these dimensional ranges provide for sufficient contact within an available packaging space for the respective components to substantially inhibit bending of tip adapter 50 whilst ensuring structural integrity of the components, particularly in response to downloads as further discussed herein. As can also be seen from the side view of FIG. 6 and the perspective view of FIG. 7, each of rearward-facing contact surface 104 and laterally-facing contact surface 100 may be vertically oriented and defines a bullnose profile in a lateral direction and a rearward direction, respectively.

Referring also now to FIG. 8-12, there are shown additional features of anti-bending stabilizer 88. Anti-bending stabilizer 88 includes a stabilizer body 89, typically a metallic casting or forging that is machined to a form suitable for service, and referred to as times interchangeably herein with anti-bending stabilizer 88. Stabilizer body 89 includes a base 96 having a downward-facing weld surface 114 defining an at least partially curved footprint. Weld surface 114 includes an outer perimeter 116 that may have an oval shape defining two foci 120. Stabilizer body 89 also includes a peripheral weld surface 118 adjoining downward-facing weld surface 114 and extending upwardly and outwardly from downward facing weld surface 114. Peripheral weld surface 118 may be at least partially conical in form. Downward-facing weld surface 114 may be planar. Peripheral weld surface 118 may extend upwardly from downward-facing weld surface 114 to a perimetric edge 140 having a shape congruent with a shape of outer perimeter 116.

Stabilizer body 89 further includes a neck 122, and hold-down head 98 extending outwardly from neck 122 and having a plurality of contact surfaces thereon. Originating at perimetric edge at 140 is a neck surface 134 that extends upwardly to transition to hold-down head 98 by way of a concave curved transition surface 136 and a concave curve transition surface 138. Transition surface 136 may define a smaller radius of curvature and transition surface 138 may define a larger radius of curvature. As can be best seen from the view in FIG. 11 neck 122 is tapered-down upwardly from base 96.

The plurality of contact surfaces may include a terminal end surface 126 facing outward from base 96, a first subterminal side surface 128, a second subterminal side surface 130, and a subterminal undersurface 132. First subterminal side surface 128 and second subterminal side surface 130 may be oriented normal to terminal end surface 126. Subterminal undersurface 132 may be orientated diagonal to terminal end surface 126 and substantially matches a slope of base contact surface 102. Terminal end surface 126 may be rectangular, and each of the plurality of contact surfaces may be planar.

Figure 9:
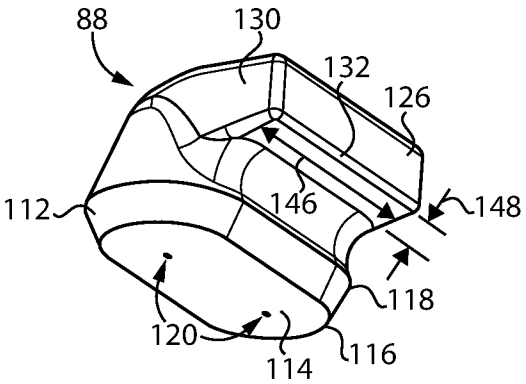
FIG. 9 is another perspective view of an anti-bending stabilizer, according to one embodiment.
Figure 8:
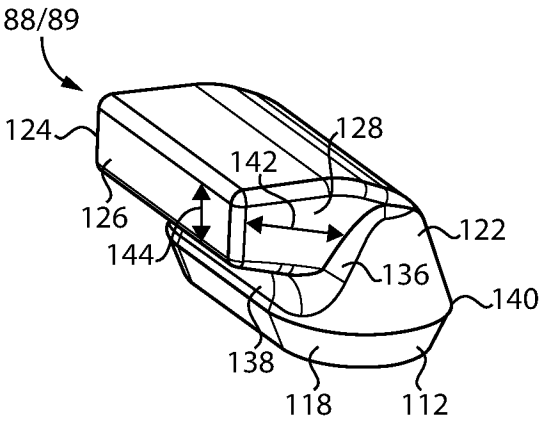
FIG. 8 is a perspective view of an anti-bending stabilizer, according to one embodiment.
Figure 12:
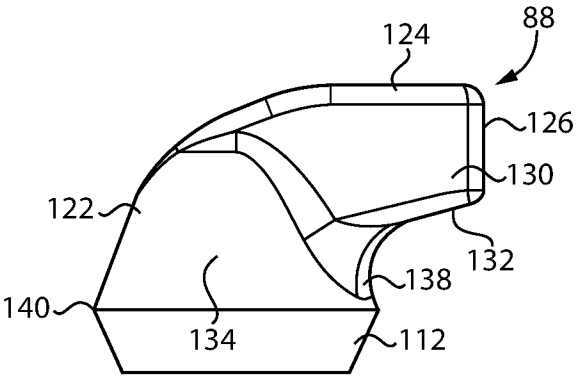
FIG. 12 is a side view of an anti-bending stabilizer, according to one embodiment.
Figure 11:
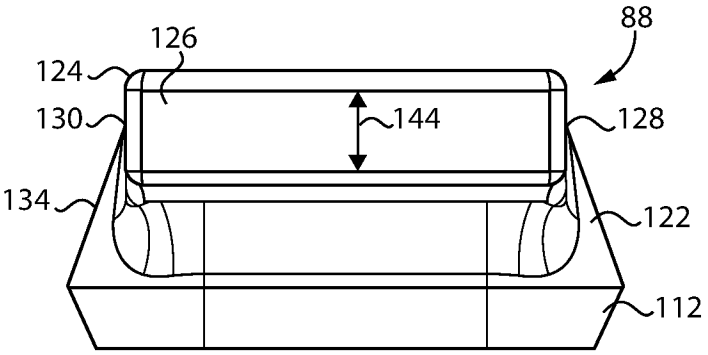
FIG. 11 is a front view of an anti-bending stabilizer, according to one embodiment.

As also illustrated in FIGS. 8, 9, and 11, the plurality of contact surfaces may include certain dimensions or dimensional ranges of length and height structured to provide a desired interface of contact with the surfaces forming the respective restraint ledges discussed herein. Terminal end surface 126 defines a height 144. Height 144 may range from 5 millimeters to 100 millimeters. First subterminal side surface 128 and second subterminal side surface 130 may define equal lengths 142. Subterminal undersurface 132 may define a length 146 and a width 148. A width of terminal end surface 126 may be equal to length 146. In an implementation, length 142 may range from 10 millimeters to 200 millimeters. Width 148 may range from 5 millimeters to 30 millimeters. Length 146 may range from 100 millimeters to 300 millimeters. It should be understood that the terms length, width, and height are used herein merely for descriptive convenience, and reference to the drawings may also be made to understand the specific dimensions referred to in the present description.

INDUSTRIAL APPLICABILITY

Referring to the drawings now generally, a work tool assembly, work tool lip, tip adapters, and anti-bending stabilizers according to the present disclosure can be sold as original equipment installed upon a machine or machine component such as a bucket, etc. In other instances, a work tool lip might be sold as a separate complete assembly or as a system of related but not assembled parts. Any of these components can also be provided as a replacement part suitable for installation in the field.

When tip adapter 50 is to be installed on work tool lip 26, tip adapter 50 may be slid into position to receive forward lip edge 34 within mounting slot 56 and tip adapter 50 tack welded in place upon work tool lip. Anti-bending stabilizers 88 may then be located based upon the temporarily positioned tip adapter 50 upon both upper and lower sides of work tool lip 26, and tack welded in place upon work tool lip 26. Tip adapter 50 can then be removed, and the process repeated for each upper pair and lower pair of anti-bending stabilizers 88. With all of the anti-bending stabilizers in place, they may be fully welded to work tool lip 26. Each tip adapter 50 can then be installed again by sliding into position to place the restraint ledges in contact with the anti-bending stabilizers, and secured such as by way of wedge assemblies 70 and/or any other securement, positioning, or support hardware that might be used. Removing tip adapters 50 may include removing any packing material such as rock soil, etc., that has made its way into the various spaces and voids within or amongst tip adapters 50 and related hardware, reversing engagement of wedge assemblies 70, and sliding tip adapters 50 off of work tool lip 26.

During service in the field it has been observed that tooth tips 28 can be subjected to a variety of different types of loading including side loads, end loads, and downward loads. Any of these types of loads can theoretically cause a tip adapter to shift and/or to bend. It will be recalled tip adapters may not be actually welded to a work tool lip. Downloads in particular, where a downward force may be applied to a tooth tip during service, can impart a tendency for the back adapter end to lift away from the upper lip surface. Oppositely directed loads can be expected to have a generally opposite effect. Over time, repeated loading of this general sort can cause loosening, displacement, or failure of the associated tip adapter ultimately and eventually affecting machine performance and/or requiring undesired downtime for repairs. According to the present disclosure the combination of tip adapter and anti-bending stabilizer geometry can improve the holding-down of a tip adapter when subjected to such loads, ultimately limiting the extent to which downloads and potentially other loads risk damage to the equipment and/or performance degradation.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A work tool assembly comprising:

a work tool lip including an upper lip surface and a lower lip surface each extending rearwardly from a forward lip edge;

a plurality of tip adapters arranged laterally along the forward lip edge, and each including a front adapter end, a back adapter end, and a mounting slot receiving the forward lip edge and extending forwardly from the back adapter end, and each mounting slot being defined between an upper adapter leg in contact with the upper lip surface and a lower adapter leg in contact with the lower lip surface;

at least one of the upper adapter leg and the lower adapter leg in each tip adapter includes, upon opposite lateral sides thereof, a first restraint ledge and a second restraint ledge, respectively; and a plurality of anti-bending stabilizers each having a base attached to the work tool lip at a location laterally of one of the plurality of tip adapters, and a hold-down head extending outwardly and laterally of the base, and such that each hold-down head extends over and is in contact with one of the first restraint ledge or the second restraint ledge of the respective one of the plurality of tip adapters to react one of up loads or down loads thereon.

2. The work tool assembly of claim 1 wherein the plurality of anti- bending stabilizers are arranged in a plurality of upper pairs each coupled to the upper adapter leg of one of the plurality of tip adapters, and a plurality of lower pairs each coupled to the lower adapter leg of one of the plurality of tip adapters.

3. The work tool assembly of claim 2 further comprising a plurality of forward tooth tips each mounted to a respective one of the plurality of tip adapters, and a plurality of set-back tooth tips arranged laterally along the forward lip edge and in an alternating arrangement with the plurality of forward tooth tips.

4. The work tool assembly of claim 3 wherein the work tool lip includes a bucket lip having a first upturned outboard lip edge, and a second upturned outboard lip edge, and each of the upper lip surface and the lower lip surface extends laterally between the first upturned outboard lip edge and the second upturned outboard lip edge.

5. The work tool assembly of claim 1 wherein each of the first restraint ledge and the second restraint ledge extends forwardly from the respective back adapter end and forms a rearward-facing contact surface, a laterally-facing contact surface, and a base contact surface, and the respective anti-bending stabilizer is in contact with each of the rearward-facing, laterally-facing, and base contact surfaces.

6. The work tool assembly of claim 5 wherein each base contact surface is sloped laterally outward in a direction of the work tool lip.

7. The work tool assembly of claim 6 wherein the hold-down head includes a terminal end surface in contact with the laterally-facing contact surface, a subterminal undersurface in contact with the base contact surface, and a subterminal side surface in contact with the rearward-facing contact surface.

8. A work tool assembly comprising:

a work tool lip including an upper lip surface and a lower lip surface each extending rearwardly from a forward lip edge;

a plurality of tip adapters arranged laterally along the forward lip edge, and each including a front adapter end, a back adapter end, and a mounting slot receiving the forward lip edge and extending forwardly from the back adapter end, and each mounting slot being defined between an upper adapter leg in contact with the upper lip surface and a lower adapter leg in contact with the lower lip surface;

at least one of the upper adapter leg and the lower adapter leg in each tip adapter includes, upon opposite lateral sides thereof, a first restraint ledge and a second restraint ledge, respectively; and a plurality of anti-bending stabilizers each having a base attached to the work tool lip at a location laterally of one of the plurality of tip adapters, and a hold-down head extending outwardly of the base and in contact with one of the first restraint ledge or the second restraint ledge of the respective one of the plurality of tip adapters; and wherein each of the first restraint ledge and the second restraint ledge extends forwardly from the respective back adapter end and forms a rearward-facing contact surface, a laterally-facing contact surface, and a base contact surface, and the respective anti-bending stabilizer is in contact with each of the rearward-facing, laterally-facing, and base contact surfaces.

9. The work tool assembly of claim 8 wherein the hold-down head includes a terminal end surface in contact with the laterally-facing contact surface, a subterminal undersurface in contact with the base contact surface, and a subterminal side surface in contact with the rearward-facing contact surface.

* * * * *